US007650742B2

(12) United States Patent
Ushijima

(10) Patent No.: US 7,650,742 B2
(45) Date of Patent: Jan. 26, 2010

(54) CABLE MADE OF HIGH STRENGTH FIBER COMPOSITE MATERIAL

(75) Inventor: Kenichi Ushijima, Niihari-gun (JP)

(73) Assignee: Tokyo Rope Manufacturing Co., Ltd., Tokyo (JP)

( * ) Notice: Subject to any disclaimer, the term of this patent is extended or adjusted under 35 U.S.C. 154(b) by 369 days.

(21) Appl. No.: 11/630,812

(22) PCT Filed: Oct. 19, 2004

(86) PCT No.: PCT/JP2004/015417

§ 371 (c)(1),
(2), (4) Date: Dec. 27, 2006

(87) PCT Pub. No.: WO2006/043311

PCT Pub. Date: Apr. 27, 2006

(65) Prior Publication Data

US 2008/0028740 A1 Feb. 7, 2008

(51) Int. Cl.
*D02G 3/02* (2006.01)

(52) U.S. Cl. ..... 57/238; 57/241

(58) Field of Classification Search ..... 57/237, 57/241

See application file for complete search history.

(56) References Cited

U.S. PATENT DOCUMENTS 2,917,891 A * 12/1959 Murdock ..... 57/237
3,029,590 A * 4/1962 Caroselli et al. ..... 57/237
3,395,529 A * 8/1968 Ray ..... 57/237
5,461,850 A * 10/1995 Bruyneel et al. ..... 57/212
6,672,046 B1 * 1/2004 Prewo et al. ..... 57/232
2003/0226347 A1 * 12/2003 Smith et al. ..... 57/210
2004/0045652 A1 * 3/2004 Vanneste et al. ..... 152/451
2004/0231312 A1 * 11/2004 Honda ..... 57/241

FOREIGN PATENT DOCUMENTS

JP 6-93579 4/1994
JP 6-128886 5/1994
JP 2002-20985 1/2002
JP 2006156346 A * 6/2006

* cited by examiner

*Primary Examiner*—Shaun R Hurley
(74) *Attorney, Agent, or Firm*—Nields, Lemack & Frame, LLC

(57) ABSTRACT

A practical cable made of a high strength fiber composite material is provided, which has high and stable strength, in addition, has even axial tension against bending and thus has a stable shape, and can be wound on a reel without shape deformation, and is hardly buckled when it is inserted into a hole or cylinder. The cable is formed by singly twisting a plurality of high strength fiber composite materials is used as a strand, and a plurality of the strands are twisted together at a twist angle of 2 to 12 degrees in a direction opposite to a twist direction of the strands, so that a double twist structure is made.

12 Claims, 8 Drawing Sheets

CABLE MADE OF HIGH STRENGTH FIBER COMPOSITE MATERIAL

TECHNICAL FIELD

The present invention relates to a cable, and particularly relates to a cable made of a high strength fiber composite material.

BACKGROUND ART

A cable using a composite material of high strength fiber and thermosetting resin as a material has properties such as high strength, low elasticity, lightweight, high corrosion resistance, high fatigue resistance, and non-magnetic property. Therefore, it is increasingly applied to various fields as a material to replace a usual steel rope or strand cable, and a PC tendon member.

There are various kinds in such a cable made of the high strength fiber composite material, and in reinforcing means of a large structure requiring high tension such as a cable for preventing deformation of a large roof, a tension tendon member of a main girder of a bridge, an outer cable of a main girder of a bridge, a stay cable of a cable stayed bridge, a main cable of a suspension bridge, or a ground anchor, a "multilayer twist structure cable" formed by lapping element wires s including high strength fiber compounded with thermosetting resin in multiple layers and twisting them together as in FIG. 1(*a*), or a "bundle structure cable" formed by bundling several unit cables k in parallel with an appropriate interval being kept from one another, the unit cable being formed by collectively twisting the element wires including high strength fiber compounded with resin, as in FIG. 1(*b*).

However, there have been the following drawbacks in such a usual cable made of the high strength fiber composite material.

First, in the former multilayer twist structure cable, element wires are in a line contact relationship to one another, and a section of the cable is in an approximately circular shape, consequently surface area is small. Therefore, when an end anchoring portion is provided for connecting the cable to another object or adding tension, sufficient anchoring efficiency is hardly obtained even if resin or cement is poured into a sleeve and solidified in order to unify the sleeve and the cable, and complicated operation of breaking a cable end into respective element wires is necessary to obtain sufficient adhesion.

Moreover, since the multilayer twist structure cable is in a configuration where all element wires are twisted together in an S or Z direction, equipment for twisting becomes larger with increase in number of element wires, leading to significant increase in equipment cost and operation cost.

In the latter parallel bundle structure cable, when respective unit cables are not uniform in length, or when the cable is disposed with being bent by a deflection portion or the like, tension is not evenly transmitted to each of unit cables in introducing tension into the cable, consequently originally designed tension of the cable may not be achieved.

Moreover, when the cable is wound on a reel to carry the cable, shape deformation occurs, therefore handling is difficult, in addition, bending stress acts due to difference in diameter between the inside and the outside of the cable, consequently the cable may be damaged.

Furthermore, since the cable is simply formed by evenly drawing the unit cables in parallel, it is weak against torsion, and in particular, when it is distorted in a direction opposite to a twist direction of the unit cables, element wires configuring the unit cables are spaced from one another, leading to damage of the cable. In addition, the cable is fatally weak against compression (buckling) in an axial direction.

Moreover, in the case that a cylindrical body is attached on the periphery of the cable, and resin or cement is filled into the cylindrical body so that the cable and the cylindrical body are unified to obtain an anchoring portion, or the case that a sheath tube storing the cable is filled with a specific gravity regulator to use the cable as a ground anchor, filler inevitably flows out to the outside through gaps between element wires of the unit cables or gaps between the unit cables, therefore complicated treatment is necessary to fill the gaps.

DISCLOSURE OF THE INVENTION

The invention was made to solve problems as above, and an object of the invention is to provide a cable made of a high strength fiber composite material, which has stable strength, in addition, has even axial tension against bending and thus has a stable shape, and can be wound on a reel without shape deformation, and is hardly buckled when it is inserted into a hole or cylinder and consequently able to provide sufficient end anchoring force.

To achieve the object, a cable made of a high strength fiber composite material of the invention has an essential feature that a cable, which is formed by singly twisting a plurality of high strength fiber composite materials including a wire of high-strength low-elasticity fiber impregnated with thermosetting synthetic resin, is used as a strand, and a plurality of the single twist strands are bundled, and twisted together at a twist angle of 2 to 12 degrees, preferably 2 to 8 degrees, in a direction opposite to a twist direction of the strands, so that a double twist structure is made.

ADVANTAGE OF THE INVENTION

According to the invention, the following excellent advantages are obtained.

1) Since the twist angle is 2 to 12 degrees, high tensile strength is kept, and since nonuniformity hardly appears in length of respective strands, tension is evenly applied to respective strands or respective element wires, consequently designed strength can be securely realized.

2) Since a cable is formed by using a cable, which is formed by singly twisting a plurality of high strength fiber composite materials including a wire of high-strength low-elasticity fiber impregnated with thermosetting synthetic resin, as a strand, and twisting the strands together, axial tension applied to each strand is even, even if the cable is bent, in addition, since the cable is in a structure having a stable shape, when the cable is wound on a reel or unwound from the reel, the shape deformation hardly occurs, consequently it can be wound in a lapped manner.

3) Furthermore, when the cable is inserted into a cylinder or hole, it is hardly damaged by buckling.

4) Since the cable has large surface area of the periphery, when end anchoring is performed, sufficient anchoring force can be obtained without need of breaking ends unlike the case of the multilayer twist cable.

5) Since a twist direction of the cable is opposite to a twist direction of the strands, rotation is small, and distortion or shape deformation hardly occurs.

6) The strands can be easily twisted together by an existing twisting machine, and intended tension can be obtained only by changing the number of strands (single twist cables) to be twisted together.

DESCRIPTION OF THE REFERENCE NUMERALS AND SIGNS

Figure 1:
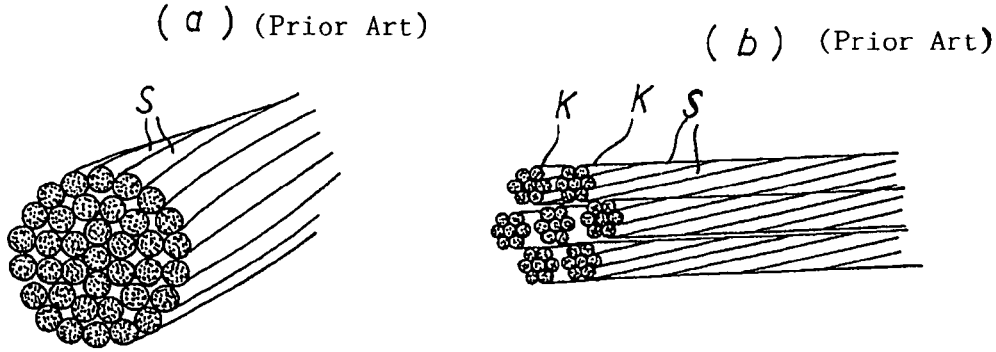
FIGS. 1(*a*) and 1(*b*) show partial perspective views of a cable made of a high strength fiber composite in the related art respectively.

1 cable made of a high strength fiber composite material of the invention

2 strand including single twist cables

2*a* core strand

2*b* side strand

3 synthetic resin base inclusion

20 composite element wire

30 filament member

31 covering layer

BEST MODE FOR CARRYING OUT THE INVENTION

A cable of the invention preferably has a core strand in the center, around which a plurality of side strands are disposed and twisted together. According to this, a cable that is high in strength and hardly deformed in shape can be made.

Preferably, a synthetic resin base inclusion is disposed in the periphery of the core strand. According to this, since contact pressure between strands themselves can be reduced by the inclusion, consequently internal wear is prevented, reduction in tensile strength can be reduced. Moreover, when the cable is inserted into a cylinder or the like, and a fluid plastic material is filled into the cylinder, filler can be prevented from flowing out from the inside of the cable (through gaps between the strands themselves) along a longitudinal direction of the cable.

The synthetic resin base inclusion may be a covering layer applied on the periphery of the strand, or a filament member disposed in gaps between the core strand and the side strands.

According to the former, since the covering layer is continuously applied to the periphery of the core strand by an extruder or the like before the strands are twisted together into a cable, operation is easy, and the number of components for fabricating the cable can be decreased. Furthermore, since covering thickness is easily adjusted, a sufficient effect of reducing the contact pressure between the strands themselves can be given. According to the latter, operation can be carried out when strands are twisted together into a cable.

The cable of the invention includes an aspect that a strand is not provided in the center, and a plurality of strands are twisted together, and again in such a case, the synthetic resin base inclusion is preferably disposed in a central portion of the cable.

According to this, since a space of the cable center is filled with the inclusion, when the cable is inserted into the cylinder or the like, and the fluid plastic material is filled into the cylinder, the filler can be prevented from flowing out from the inside of the cable (through gaps between the strands) along a longitudinal direction of the cable. In addition, since contact pressure between strands themselves can be reduced at the same time, consequently internal wear is prevented, reduction in tensile strength can be reduced.

The cable of the invention is fabricated according to one of the following two methods. In each method, since only one curing is enough, a process can be simplified.

1) The cable is formed in a process that a strand having a single twist structure with synthetic resin being uncured is fabricated through a layering step, lapping step, and primary closing step, then a plurality of the strands with uncured resin are twisted together into a cable in a secondary closing step, and finally the whole is cured in a curing step.

2) The cable is formed in a process that a strand having a single twist structure with resin being cured is fabricated through the layering step, lapping step, primary closing step, and curing step, then a plurality of the strands with cured resin are twisted together into a cable in the secondary closing step.

For the cable having the core strand in the center, the following fabrication method can be used. According to this, since resin of a strand to be the core strand has been cured, the synthetic resin base inclusion can be easily applied, in addition, since the core strand has stiffness through curing of the resin, operation of bundling side strands and twisting them together can be smoothly performed.

The cable is formed in a process that a single strand having a single twist structure with resin being cured is fabricated through the layering step, lapping step, primary closing step, and curing step, and separately from this, a plurality of strands having a single twist structure with resin being uncured are fabricated through the layering step, lapping step, and primary closing step, then the strand having the single twist structure with resin being cured is used as the core strand, around which the strands having the single twist structure with resin being uncured are disposed as the side strands, and then the strands are twisted together into a cable in a secondary closing step, and finally the side strands with resin being uncured are cured in the curing step.

Example 1

Hereinafter, examples of the invention will be described with reference to drawings.

Figure 2:
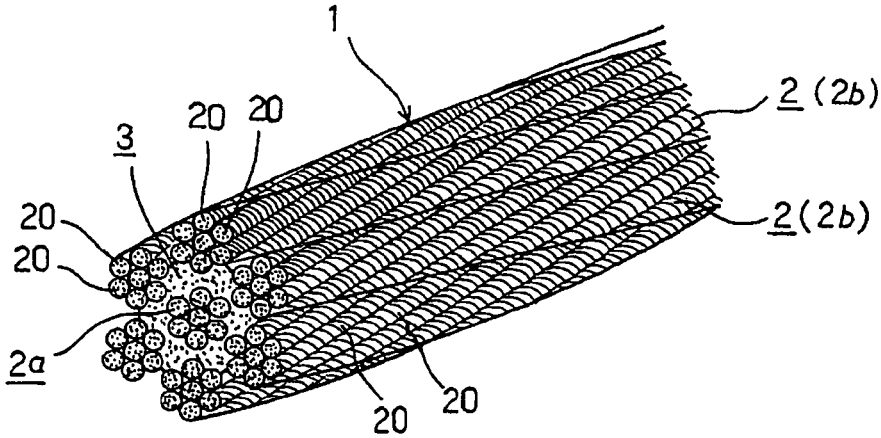
FIG. 2 shows a partial perspective view showing an example of a cable made of a high strength fiber composite material according to the invention.

FIG. 2 shows an embodiment of a cable according to the invention, wherein a reference 1 indicates a cable as a whole made of a high strength fiber composite material, and a reference 2 indicates a strand including cables having a structure where a plurality of element wires 20 including high-strength low-elasticity fiber compounded with thermosetting resin are evenly drawn and twisted in an S or Z direction (this is called single twist).

Figure 4:
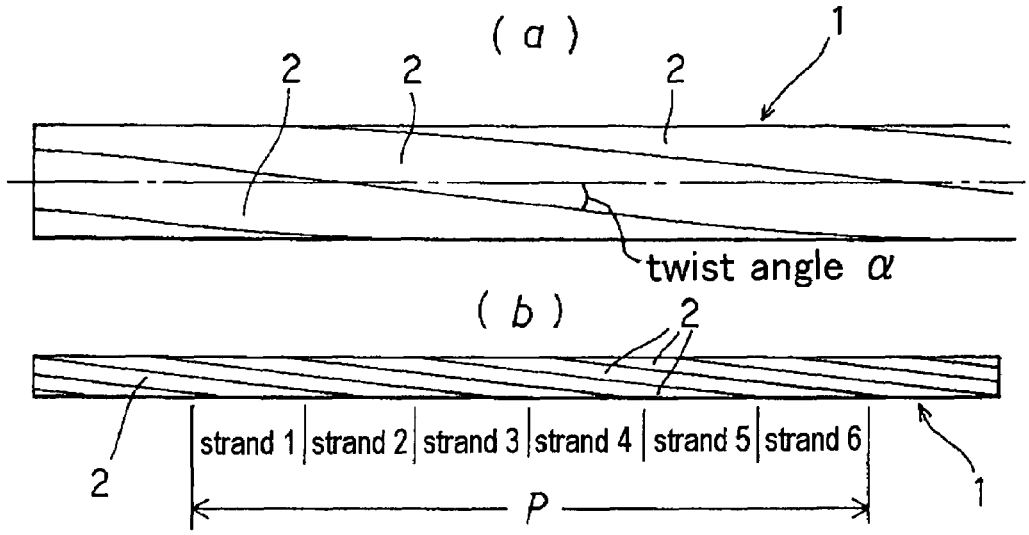
FIG. 4(*a*) shows an explanatory view showing a twist angle of the cable of the invention, and FIG. 4(*b*) shows an explanatory view showing twist length of the cable.

The cable 1 is formed in a way that a plurality of the strands (seven strands in the figure) having the single twist structure are evenly drawn, and twisted together at a long twist pitch, that is, at an angle of 2 to 12 degrees as a twist angle $\alpha$ as shown in FIG. 4 into a cable having a predetermined thickness.

In this example, a single strand 2*a* is disposed in the center as the core strand, around which six strands 2*b* are disposed as side strands, and a synthetic resin base inclusion 3 is disposed around the core strand 2*a*. The inclusion 3 exists continuously in a longitudinal direction.

In detailed description of the structure, each strand 2 (2*a*, 2*b*) is formed of a plurality of composite element wires 20 including high-strength low-elasticity fiber selected form carbon fiber, aramid fiber, and silicon carbide fiber impregnated with thermosetting resin selected from epoxy series resin, unsaturated polyester series resin, polyurethane resin, and bismaleimide resin as matrix, and thus compounded with the thermosetting resin. When the cable is required to have heat resistance of more than 200° C., bismaleimide resin is preferably used.

Figure 3:
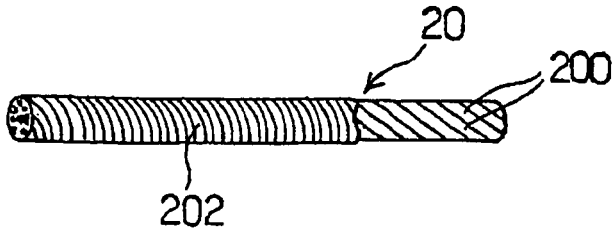
FIG. 3 shows a partial perspective view showing a composite element wire of the invention.

As shown in FIG. 3, in the composite element wire 20, many members as prepreg 200 of high-strength low-elasticity fiber are bundled or twisted together at a long twist pitch, then a cover is provided on the periphery of the bundled or twisted prepreg members, the cover being configured by spirally lapping synthetic fiber yarn 202 such as high-strength low-elasticity fiber or polyester fiber.

A twist direction of the strands 2 (2*a*, 2*b*) is opposite to a twist direction of the cable 1 made of the high strength fiber composite material. This is to reduce rotation and make distortion and shape deformation to hardly occur. For example, when a direction of twist for obtaining the strands 2 (2*a*, 2*b*) by evenly drawing a plurality of the composite element wires 20 and twisting them together is a direction S, a direction of twist in twisting a plurality of such strands together is a direction Z.

In a usual case, a twist pitch P in twisting the strands into the cable 1 is large compared with a twist pitch P1 in the case of obtaining the strands 2 (2*a*, 2*b*), and the reason for limiting the twist angle $\alpha$ in twisting the strands 2 (2*a*, 2*b*) into the cable 1 to 2 to 12 degrees is to achieve target tensile strength without damage or shape deformation, and to enable a twisting step to be easily carried out using an existing twisting machine. Furthermore, it is because an advantage that the curing step of thermosetting resin is not limited to a final step is given, as described later.

The reason why the lower limit of the twist angle is specified as two degrees is because when it is lower than two degrees, while high tensile strength is obtained, since strands are arranged approximately in parallel, drawbacks of a cable in the related art as, described before, that is, a point that when the cable is wound on a reel, shape deformation occurs, leading to difficulty in handling, a point that bending stress acts due to difference in diameter between the inside and the outside of the cable, consequently the cable may be damaged, and a point that it is weak against torsion, and in particular, when it is distorted in a direction opposite to a twist direction of the cable, the element wires are spaced from one another, leading to breakage, can not be solved.

The reason why the upper limit of the twist angle is specified as twelve degrees is because when it is more than twelve degrees, tensile strength is reduced. That is, since the high strength fiber composite material is a perfectly brittle material that is weak against bending, sharing, and torsion, when strands of the material are twisted together, difference in angle between a tension direction and a fiber direction is increased, leading to reduction in strength due to shearing. In this sense, more preferable twist angle $\alpha$ is 2 to 8 degrees.

Next, the inclusion 3 preferably exists while it may not exist. The reason for this is as follows. When strands are contacted to one another, in the case that the cable is applied with tension or bent, element wires are damaged due to a rubbing action or lateral pressure between the element wires themselves, consequently sufficient strength can not be exhibited. On the contrary, existence of the inclusion 3 reduces contact between the core strand 2*a* and the side strands 2*b*, in addition, since existence of the inclusion 3 apparently expands the core strand, contact between the side strands themselves is also reduced by such a diameter expansion action, consequently reduction in tensile strength due to internal wear (twist abrasion) can be reduced.

Furthermore, when the cable 1 is inserted into a hole or cylinder, and filler such as cement milk or resin is poured into a space between the periphery of the cable and the hole or cylinder to obtain an end anchoring portion or anchor, infiltration of the filler into the inside of the cable (gaps between the strands themselves) is obstructed, consequently a phenomenon that the filler is infiltrated into a central portion and flows out in a longitudinal direction of the cable can be prevented.

The inclusion 3 preferably includes comparatively soft synthetic resin so that softness of the cable is not lost, and thermoplastic resin such as polyethylene is given as a typical example.

Figure 5:
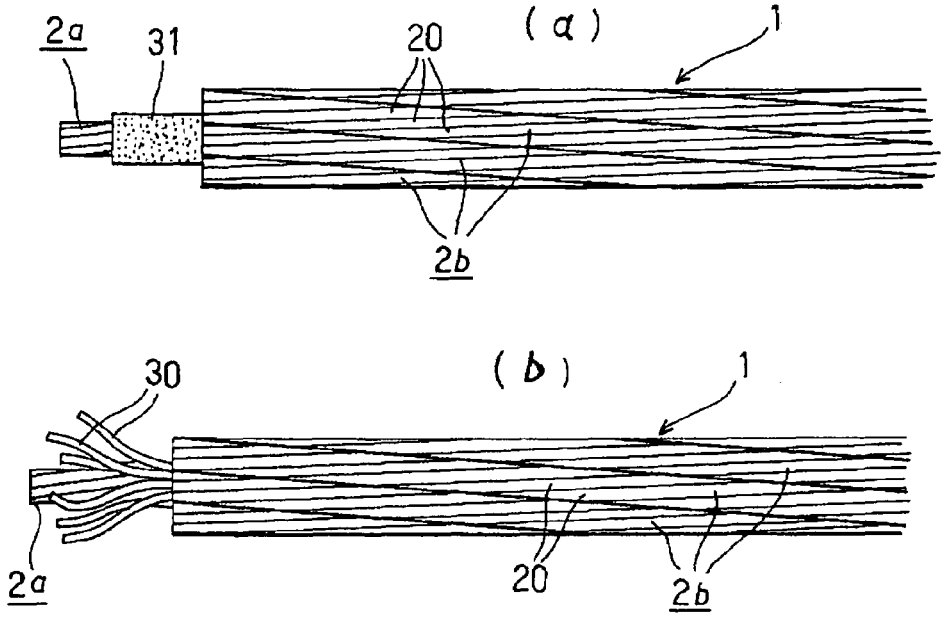
FIGS. 5(*a*) and 5(*b*) show side views illustrating an inclusion of the cable of the invention.

The inclusion 3 is unified with the strand 2*a* in the example of FIG. 2. This is achieved by using a resin extruder, and extruding melted resin around the strand which is passing through the machine, thereby previously forming a covering layer 31 on the periphery of the strand 2*a* as shown in FIG. 5(*a*). While the covering layer 31 may have a cylindrical surface, it may have a spiral groove in accordance with a layout of the side strands 2*b*. As thickness of the covering layer 31, size enough to achieve the object is appropriately selected from a range of, for example, 0.3 to 5.0 mm.

Moreover, the inclusion 3 may be a filament member made of thermoplastic synthetic resin independent of the strand 2*a*. In this case, as in FIG. 5(*b*), a plurality of filament members 30 are used, and disposed in spiral valleys of the strand 2*a*.

This method has an advantage that it can be carried out when the strands 2 (2*a*, 2*b*) are twisted together into the cable.

Figure 6:
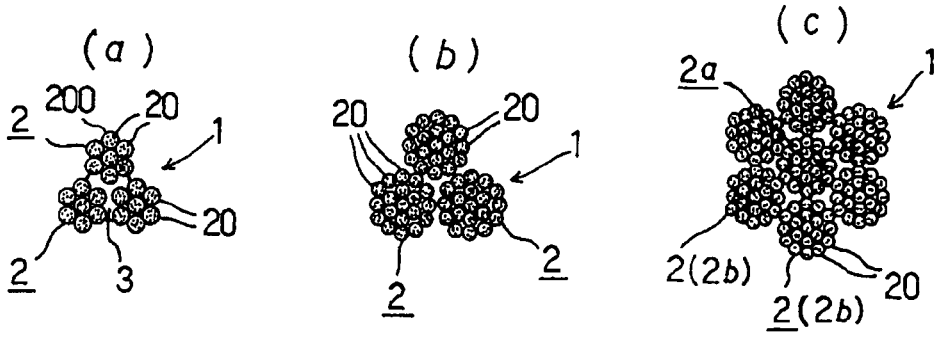
FIGS. 6(*a*), 6(*b*) and 6(*c*) show cross section views showing other examples of the cable of the invention respectively.

The invention is not limited to the shown examples. FIG. 6 shows other examples of the invention.

1) The number of composite element wires 20 configuring the strand 2 can be three or more, and not limited to the case of seven as in FIG. 2. For example, it may be nineteen as in FIGS. 6(*b*) and 6(*c*). In FIG. 6(*c*), a 7×19 structure is used. In the figure, the inclusion 3 is omitted to be shown.

2) The cable 1 is not necessarily limited to a cable in the case of having the core strand 2*a*, and may have a structure where the core strand is not provided. FIGS. 6(*a*) and 6(*b*) show examples of such a structure, in which a 3×7 structure and a 3×19 structure using three strands 2 are employed. When the core strand is not provided in this way, the inclusion 3 is disposed in the center of the cable in a core configuration as typically shown in FIG. 6(*a*), and interposed such that it appropriately separates the stands 2, 2 from one another. In this case, a filament member made of thermoplastic resin, which is molded to have a section of a polygon or a shape similar to the polygon, can be used for the inclusion 3.

Figure 7:
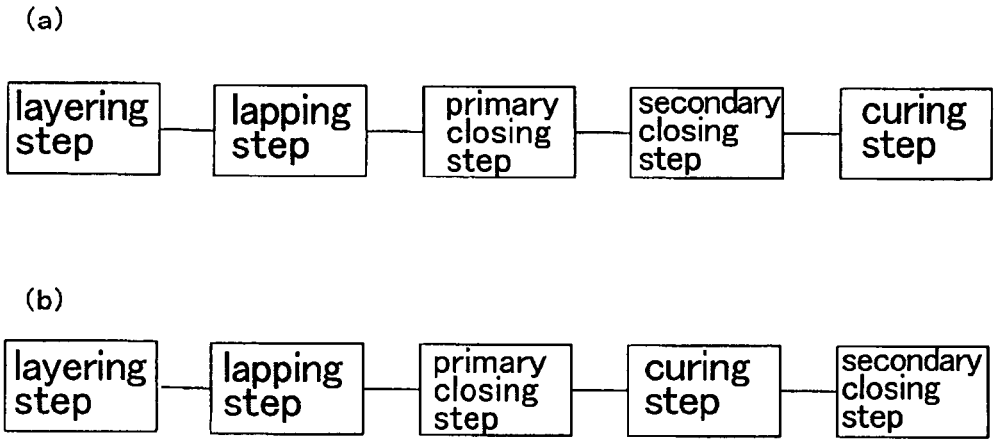
FIGS. 7(*a*) and 7(*b*) show explanatory views showing examples of a manufacturing process of the cable of the invention respectively.
Figure 8:
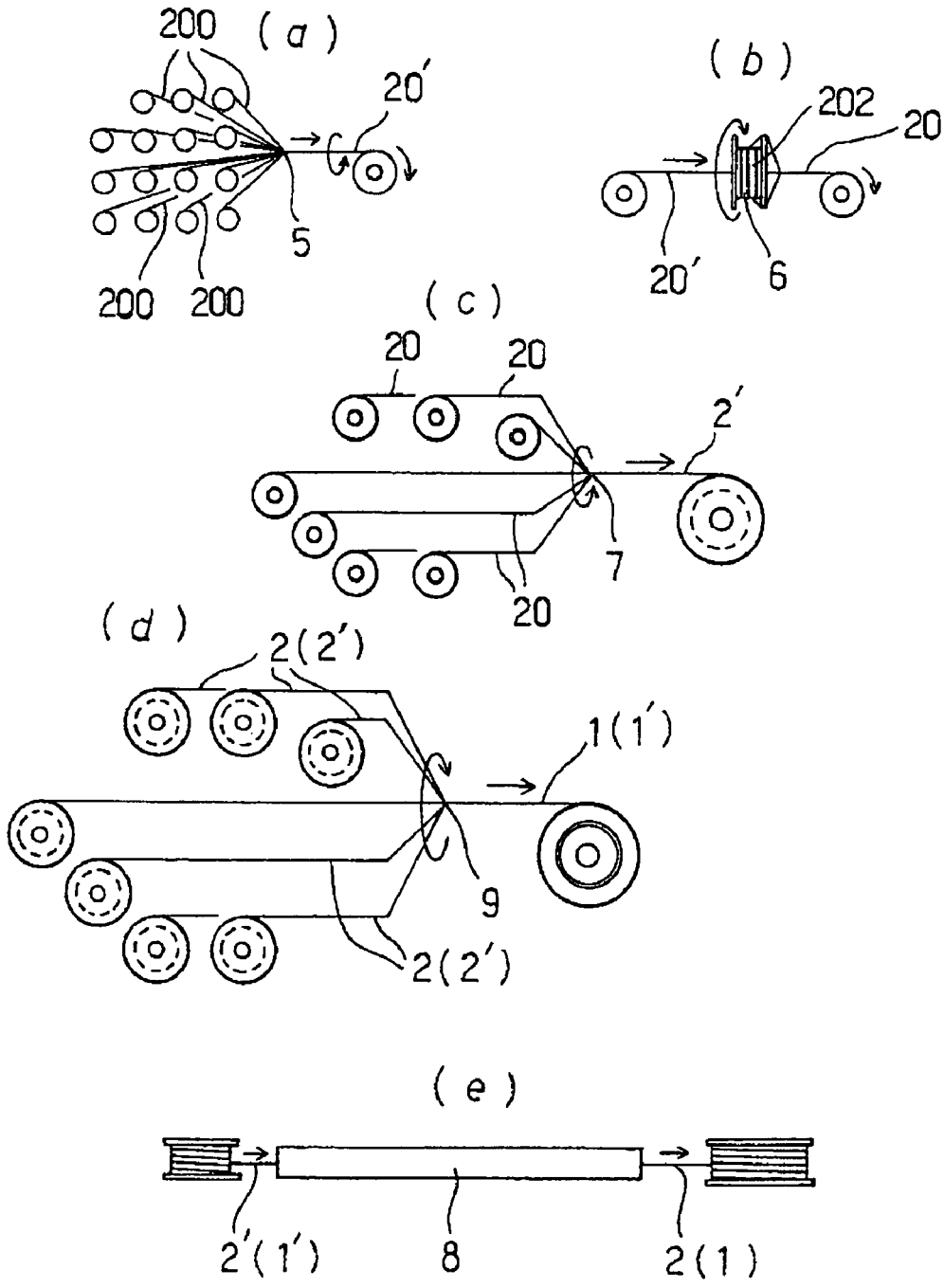
FIG. 8(*a*) shows an explanatory view of a layering step, FIG. 8(*b*) shows an explanatory view of a lapping step, FIG. 8(*c*) shows an explanatory view of a primary closing step, FIG. 8(*d*) shows an explanatory view of a secondary closing step, and FIG. 8(*e*) shows an explanatory view of a curing step.

Next, a fabrication process of the cable made of the high strength fiber composite material according to the invention is described. FIGS. 7 and 8 show two examples of the fabrication process.

In a first method, a strand having a single twist structure with resin being uncured is fabricated through a layering step, lapping step, and primary closing step, then a plurality of the uncured strands are twisted together into a cable 1 in a secondary closing step, and finally the whole is cured in a curing step.

In a second method, a strand having a single twist structure with resin being cured is fabricated through the layering step, lapping step, primary closing step, and curing step, then a plurality of the strands are twisted together into a cable in the secondary closing step.

There is a third step used in the case of a cable having the core strand. In the method, a single strand having a single twist structure with resin being cured is fabricated through the layering step, lapping step, primary closing step, and curing step, and separately from this, strands having a single twist structure with resin being uncured are fabricated through the layering step, lapping step, and primary closing step. Then, the strand with resin being cured is used as the core strand, around which the strands with resin being uncured are disposed as the side strands, and then the strands are twisted together into a cable in a secondary closing step, and finally the side strands with resin being uncured are cured in the curing step.

The steps are described in detail. In the layering step, many (for example, 10 to 20) members as prepreg 200 impregnated with thermosetting resin are fed from bobbins to a twisting machine 5 respectively and twisted together at a predetermined pitch to obtain a composite element wire 20', as shown in FIG. 8(*a*).

In the lapping step, while a plurality of (for example, seven) composite element wires 20' are fed out, synthetic fiber yarn 202 is paid out from a lapping machine 6 and spirally wound on the periphery of the composite element wires 20', as shown in FIG. 8(*b*).

In the first closing step, for example, seven composite element wires 20' after lapping are paid out from bobbins respectively as shown in FIG. 8(*c*), and twisted together at a predetermined pitch, for example, 100 to 200 mm by a closing machine 7. Thus, a strand 2' including a single twist structure with resin being uncured is obtained.

In the first method, when the composite element wires 20 after lapping are twisted together at the predetermined pitch, for example, 100 to 200 mm by a closing machine 7, thereby the strands 2' with resin being uncured are obtained, the strands 2' as it is are introduced into a closing machine 9, as in FIG. 8(*d*), and twisted together with the twist angle in a range of 2 to 12 degrees and in a twist direction opposite to a twist direction in the strand twisting step, thereby an element cable 1' with resin being uncured is obtained. Then, the element cable 1' is allowed to pass through a tunnel-like heat treatment furnace 8 to be heated at 120 to 135° C., so that resin is cured to obtain the cable 1 of the invention.

In the second method, the strands 2' with resin being uncured are allowed to pass through the tunnel-like heat treatment furnace 8 to be heated at 120 to 135° C. as in FIG. 8(*e*), so that the strands 2 with resin being cured are obtained. Then, the strands 2 with cured resin are twisted together by the closing machine 9 to obtain the cable 1 of the invention. At that time, the twist angle is in a range of 2 to 12 degrees, and the twist direction is opposite to the twist direction in the strand twisting step. In the first and second methods, since only one curing step is enough, process is simple.

When the inclusion 3 is disposed, in the cable structure where the core strand is not provided, the secondary closing step can be performed in a manner that a filament or filament member to be the inclusion is disposed in the center, and strands are disposed around it.

In the case of the cable structure having the core strand, the secondary closing step can be performed in a manner that the periphery of one strand is applied with a covering layer, and other strands 2*b* are disposed with the one strand as a center. The strands may have been cured or uncured.

The third method has an advantage that when uncured side strands 2*b* are twisted together, since the stiff strand 2*a* with cured resin exists in the center, the twisting step is easily carried out.

A specific example of the cable of the invention is described. The cable of the invention is fabricated using the second method as a fabrication method.

Fifteen members as prepreg formed by bundling 12000 fibers 7 μm in diameter including carbon fiber impregnated with epoxy resin were twisted together at a pitch of 90 mm in a twist direction Z, then the twisted members as prepreg were subjected to lapping, so that composite element wires 4.2 mm in outer diameter were obtained.

Seven of the element wires were twisted together at a pitch of 160 mm in a twist direction S, so that cable strand in a 1×7 structure was obtained. The strands were heated at 130° C. for 90 min in a heat treatment furnace to cure the resin.

One of the seven strands was allowed to pass through a resin extruder and thus the periphery of the strand was applied with a cover of polyethylene 2 mm in thickness, thereby a core strand was made. Six strands that were not applied with the cover were used as side strands, and twisted together at a twist angle α in range of 2 to 18 degrees in a twist direction Z, so that a cable having a double twist structure in a 7×7 structure was obtained.

A twist pitch at a twist angle α of 2 degrees is 2200 mm, a twist pitch at a twist angle α of 4.1 degrees is 1100 mm, and a twist pitch at a twist angle α of 5 degrees is 900 mm.

Figure 9:
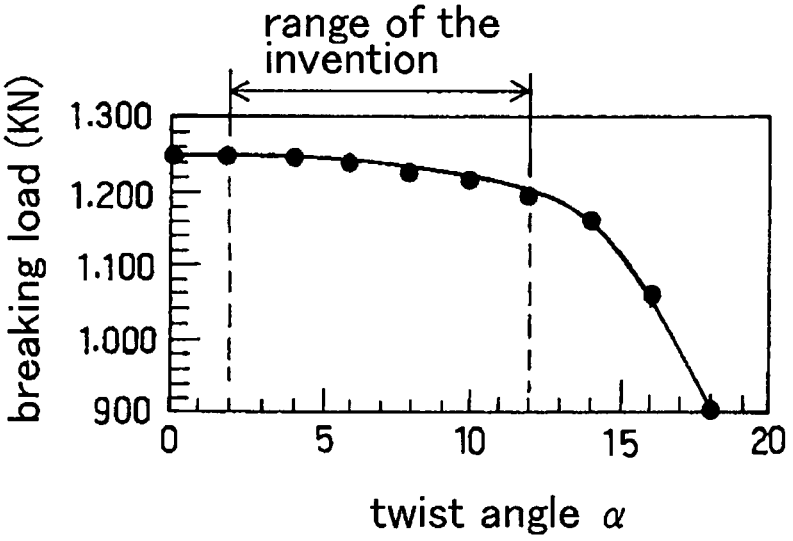
FIG. 9 shows a diagram showing a relationship between a twist angle and breaking load.

FIG. 9 shows a result of tensile tests at nine levels on the obtained double twist cable.

It is known from the result that when the twist angle is in a range of 2 to 12 degrees, and particularly 2 to 8 degrees, reduction in breaking load is hardly shown.

For comparison, a strand that was not applied with the cover on the periphery was used as the core strand, and a double twist cable in the 7×7 structure was fabricated at a twist angle α of 4 degrees, and subjected to a tensile test. As a result, breaking load was 1100 kN. In the double twist cable having the core strand applied with the cover, it was 1250 kN at the same twist angle, therefore comparatively high breaking load was obtained. It is known from this that the resin inclusion is effective.

Moreover, seven of the strands were bundled to fabricate a cable in the related are (called example 2 in the related art), which was provided for comparison of breaking load. As a result, breaking load was 1070 kN in the example 2 in the related art, which was bad compared with the cable of the invention.

In the cable of the invention, a relationship between reel body diameter and twist length was investigated by a winding test. As a result, it was confirmed that when the twist angle α was in a range of 2 to 18 degrees, if a ratio of twist length P/reel body diameter D was 0.73 or less, the cable was able to be normally wound as in FIG. 10(*a*). In a twist angle α of 1.6 degrees, that is, a twist pitch of 2800 mm, when P/D is 0.93, damage or shape deformation occurred in the cable during winding.

Figure 10:
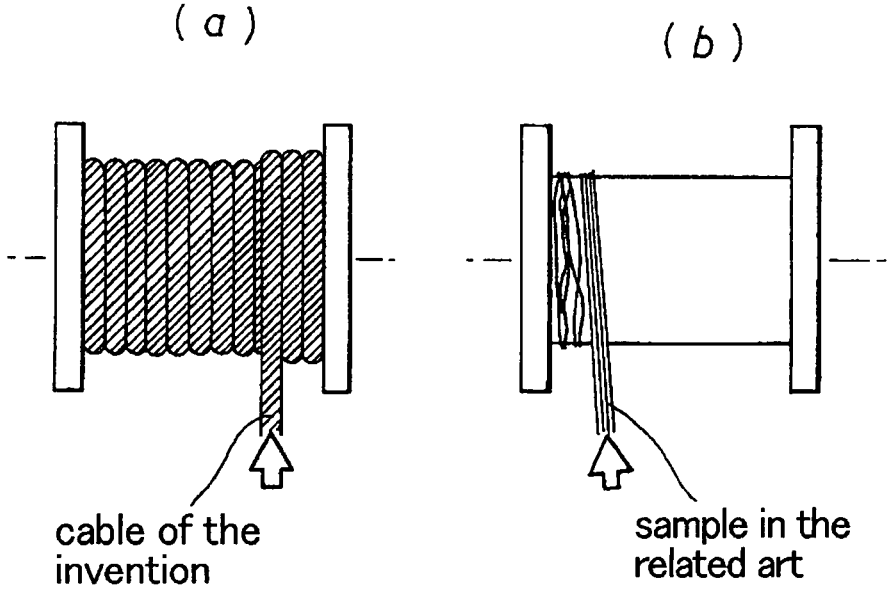
FIG. 10(*a*) shows a plane view showing a winding test condition of the cable of the invention, and FIG. 10(*b*) shows a plane view showing a winding test condition of a cable in the related art.

For comparison, the example 2 in the related art was also subjected to the winding test, and as a result, shape deformation occurred as in FIG. 10(*b*), consequently lap winding was not able to be performed.

Figure 11:
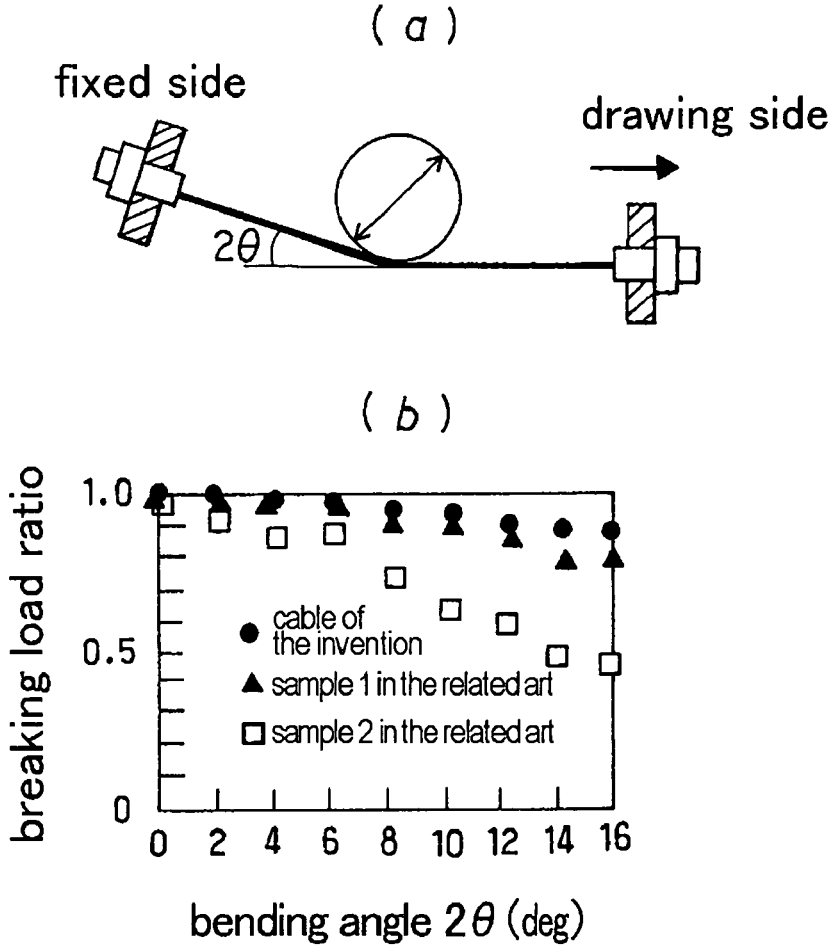
FIG. 11(*a*) shows an explanatory view showing an outline of a bending tension test, and FIG. 11(*b*) shows a diagram showing a twist angle and breaking load of each of the cable of the invention and cables in the related art.

The cable of the invention (7×7 structure) at a twist angle α of four degrees in a type where the core strand was applied with the polyethylene cover was subjected to a bending tensile test in a range of a bending angle of 2θ of 0 to 8 degrees assuming that bending diameter is 200 mm, as in FIG. 11(*a*).

For comparison, a cable in a 1×37 structure having the same section area (example 1 in the related art) and a cable formed by bundling seven strands (example 2 in the related art) were subjected to the same bending tensile test. Results of the tests were shown in FIG. 11(*b*). As known from the figure, while reduction in breaking load due to bending is extremely large in the example 2 in the related art, the cable of the invention exhibits excellent bending performance.

Figure 12:
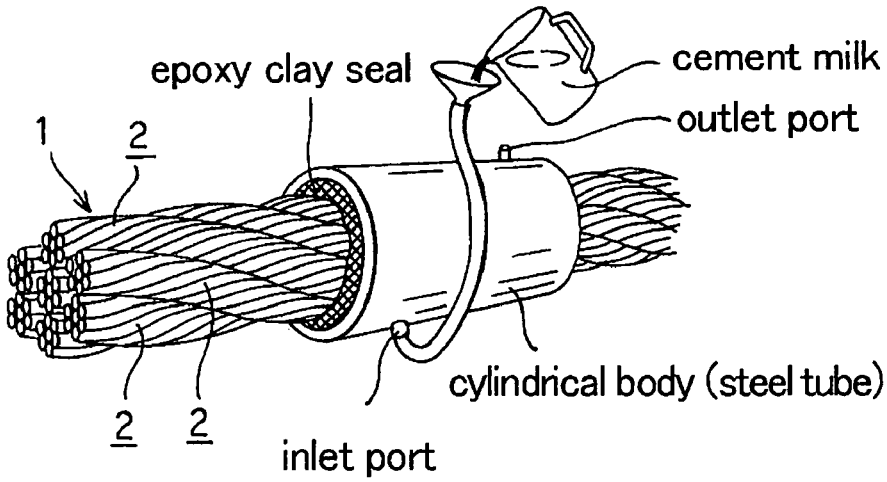
FIG. 12 shows a perspective view showing a filling test condition.

A result of a leakage test is shown. As in FIG. 12, a cylindrical body made of steel is coaxially covered on the periphery of a cable in the 7×7 structure having the core strand applied with the polyethylene cover, then cement milk was poured into a space along concave portions of the cable from an inlet port provided in a lower portion of the cylindrical body while openings at both ends of the cylindrical body were sealed by packing epoxy clay therein. As a result, filling was successfully carried out without flowing out of the cement from the inside of the cable to a free end of the cable. It is known from the result that the inclusion is effective.

Figure 13:
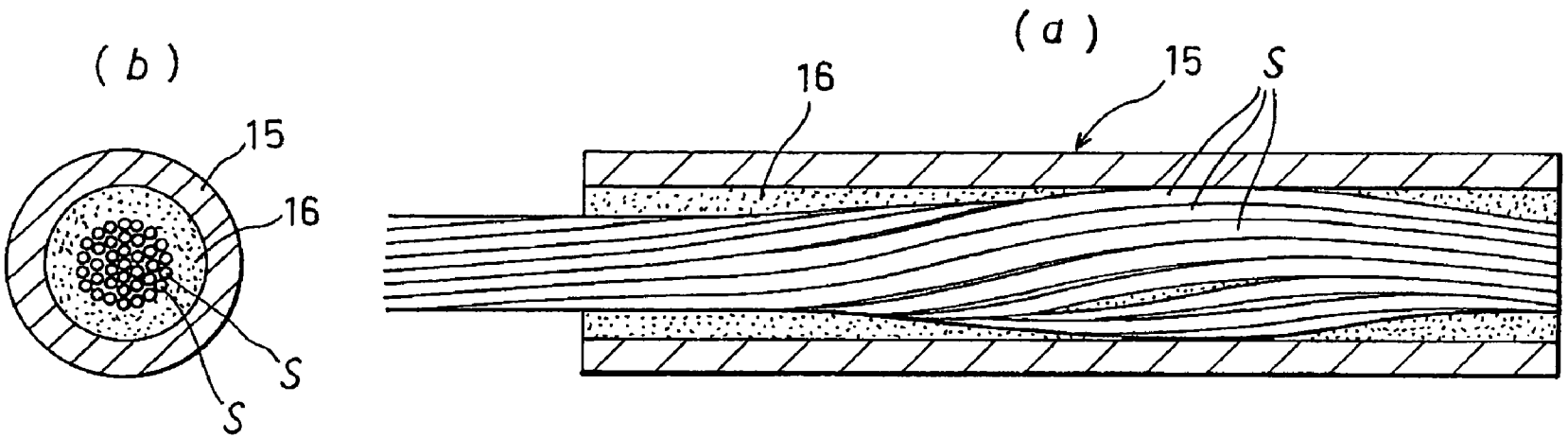
FIG. 13(*a*) shows a longitudinal section side view showing a condition of end anchoring of the cable of the invention, and FIG. 13(*b*) shows a lateral section view of it.
Figure 14:
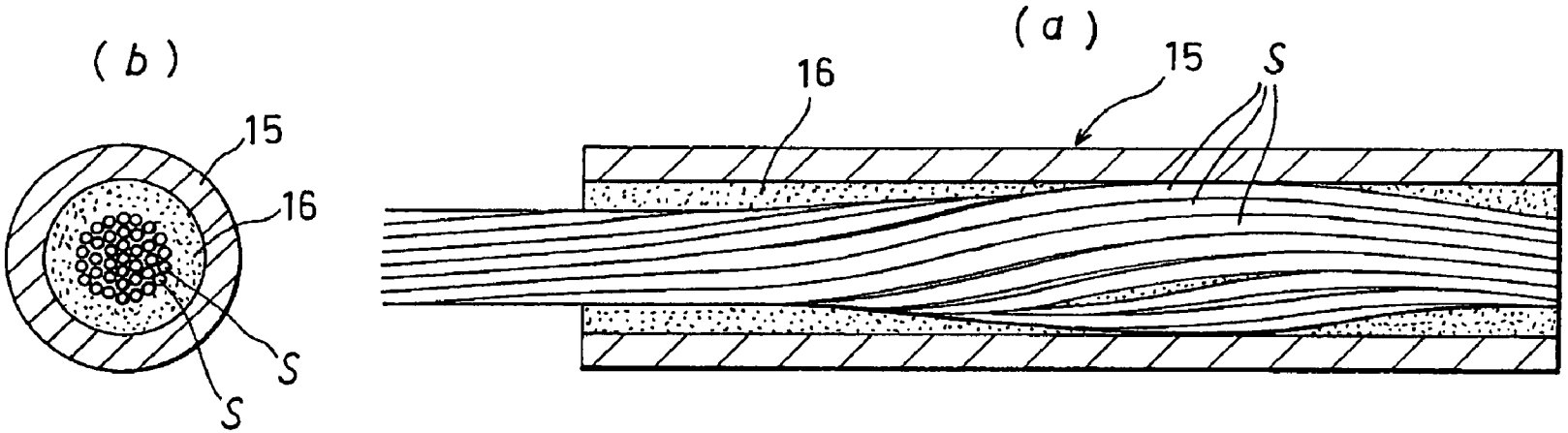
FIG. 14 (*a*) shows a longitudinal section side view showing a condition of end anchoring of the cable of a multilayer twist cable in the related art, and FIG. 14(*b*) shows a lateral section view of it.

Moreover, a test of anchoring performance was conducted. As shown in FIG. 13, the cable 1 of the invention was inserted into a steel sleeve 15, and then cement milk 16 was poured. For comparison, in the example 1 in the related art, the cable were inserted into the sleeve with element wires being broken, then the cement milk was poured, as in FIG. 14. As a result, high anchoring strength was obtained in the cable 1 of the invention, while respective strands were not broken. This is because, in the cable of the invention, since the strands are in point contact relationship to one another, irregularity on the periphery of the cable is large, therefore adhesion surface area is large, and the spiral of the strands works as drawing resistance.

INDUSTRIAL APPLICABILITY

The cable of the invention is preferable for reinforcement of structures under corrosion environment, for example, a tension tendon member of a main girder of a bridge, a post tension type, outer cable of a girder of a bridge, and a cable for preventing deformation of a large roof, in addition, effective for a bridge cable such as a stay cable of a cable stayed bridge, and a main cable of a suspension bridge, and furthermore, effective for a ground anchor.

The invention claimed is:

1. A cable made of a high strength fiber composite material, comprising a plurality of strands each comprising a plurality of singly twisted high strength fiber composite materials including a wire of high-strength low-elasticity fiber impregnated with thermosetting synthetic resin, said plurality of single twisted strands being bundled, and twisted together at a twist angle of 2 to 12 degrees in a direction opposite to a twist direction of the strands, so that a double twist structure is made.

2. The cable made of the high strength fiber composite material according to claim 1: wherein the twist angle is 2 to 8 degrees.

3. The cable made of the high strength fiber composite material according to claim 1: wherein said plurality of strands are side strands, and wherein said cable has a core strand in the center, around which said plurality of side strands are disposed and twisted together.

4. The cable made of the high strength fiber composite material according to claim 3: wherein a synthetic resin base inclusion is disposed on the periphery of the core strand.

5. The cable made of the high strength fiber composite material according to claim 4: wherein the synthetic resin base inclusion is a covering layer applied on the periphery of the strand.

6. The cable made of the high strength fiber composite material according to claim 4: wherein the synthetic resin base inclusion is a filament member disposed in a gap between the core strand and the side strands.

7. The cable made of the high strength fiber composite material according to claim 1: wherein the cable does not have a strand in the center, and a plurality of strands are twisted together.

8. The cable made of the high strength fiber composite material according to claim 7: wherein a synthetic resin base inclusion is disposed in a central portion of the cable.

9. The cable made of the high strength fiber composite material according to claim 1: wherein the cable is formed in a process that a strand having a single twist structure with synthetic resin being uncured is fabricated through a layering step, lapping step, and primary closing step, then a plurality of the strands with uncured resin are twisted together into a cable in a secondary closing step, and finally the whole is cured in a curing step.

10. The cable made of the high strength fiber composite material according to claim 1: wherein the cable is formed in a process that a strand having a single twist structure with resin being cured is fabricated through a layering step, lapping step, primary closing step, and curing step, then a plurality of the strands with cured resin are twisted together into a cable in a secondary closing step.

11. The cable made of the high strength fiber composite material according to claim 3: wherein the cable is formed in a process that a single strand having a single twist structure with resin being cured is fabricated through a layering step, lapping step, primary closing step, and curing step, and separately from this, a plurality of strands having a single twist structure with resin being uncured are fabricated through a layering step, lapping step, and primary closing step, then the strand having the single twist structure with resin being cured is used as a core strand, around which the strands having the single twist structure with resin being uncured are disposed as side strands, and then the strands are twisted together into a cable in a secondary closing step, and finally the side strands with resin being uncured are cured in a curing step.

12. The cable made of the high strength fiber composite material according to claim 11: wherein the strand having the single twist structure with resin being cured includes a strand having synthetic resin base inclusion on a periphery.

* * * * *